US009821183B2

(12) United States Patent
Frasure et al.

(10) Patent No.: US 9,821,183 B2
(45) Date of Patent: Nov. 21, 2017

(54) MOTORIZED ACTUATOR FOR A FIRE EXTINGUISHER

(71) Applicant: Kidde Technologies, Inc., Wilson, NC (US)

(72) Inventors: David Frasure, Wilson, NC (US); John Wright Porterfield, Jr., Raleigh, NC (US)

(73) Assignee: KIDDE TECHNOLOGIES, INC., Wilson, NC (US)

( * ) Notice: Subject to any disclaimer, the term of this patent is extended or adjusted under 35 U.S.C. 154(b) by 157 days.

(21) Appl. No.: 14/328,810

(22) Filed: Jul. 11, 2014

(65) Prior Publication Data

US 2016/0008648 A1 Jan. 14, 2016

(51) Int. Cl.

| | |
|---|---|
| ***A62C 2/00*** | (2006.01) |
| ***A62C 37/46*** | (2006.01) |
| ***A62C 13/64*** | (2006.01) |
| ***A62C 35/13*** | (2006.01) |
| *A62C 3/08* | (2006.01) |

(52) U.S. Cl.

CPC ..... *A62C 37/46* (2013.01); *A62C 13/64* (2013.01); *A62C 35/13* (2013.01); *A62C 3/08* (2013.01)

(58) Field of Classification Search

CPC ..... A62C 37/46
USPC ..... 169/46
See application file for complete search history.

(56) References Cited

U.S. PATENT DOCUMENTS

| | | | | |
|---|---|---|---|---|
| 1,918,191 A | | 7/1933 | Paulus et al. | |
| 3,948,540 A | | 4/1976 | Meacham | |
| 4,492,103 A | | 1/1985 | Naumann | |
| 4,596,289 A | | 6/1986 | Johnson | |
| 4,620,598 A | | 11/1986 | Reeder | |
| 4,830,052 A | * | 5/1989 | Oberlin | F16K 17/1626 137/68.24 |

(Continued)

FOREIGN PATENT DOCUMENTS

| | | |
|---|---|---|
| DE | 3826300 | 12/1988 |
| EP | 2586498 | 5/2013 |

(Continued)

OTHER PUBLICATIONS

EP Application No. 15175180.7 Extended European Search Report dated Dec. 1, 2015, 9 pages.

(Continued)

*Primary Examiner* — Christopher Kim
*Assistant Examiner* — Adam J Rogers
(74) *Attorney, Agent, or Firm* — Cantor Colburn LLP

(57) ABSTRACT

According to one aspect, a fire extinguisher includes a fire extinguisher reservoir and a fire extinguisher outlet burst disc that forms a discharge barrier between the fire extinguisher reservoir and a discharge head to retain a pressurized fire extinguishing agent within the fire extinguisher reservoir. The fire extinguisher actuator assembly includes a cutter positioned within the fire extinguisher proximate the fire extinguisher outlet burst disc. The fire extinguisher actuator assembly also includes a motorized activation device having a drive shaft. The motorized activation device is operable to rotate the drive shaft and push the cutter to pierce the fire extinguisher outlet burst disc, thereby releasing the pressurized fire extinguishing agent through the discharge head.

10 Claims, 7 Drawing Sheets

(56) References Cited

U.S. PATENT DOCUMENTS

| | | | | |
|---|---|---|---|---|
| 5,010,911 | A * | 4/1991 | Grant | F16K 31/082 137/68.3 |
| 5,230,531 | A * | 7/1993 | Hamilton | B60R 21/272 222/5 |
| 5,458,202 | A | 10/1995 | Fellows et al. | |
| 5,462,307 | A | 10/1995 | Webber et al. | |
| 5,676,190 | A | 10/1997 | Matsumoto et al. | |
| 5,918,681 | A | 7/1999 | Thomas | |
| 6,076,610 | A | 6/2000 | Zwergel | |
| 6,164,383 | A | 12/2000 | Thomas | |
| 6,182,698 | B1 | 2/2001 | Barak | |
| 6,189,624 | B1 | 2/2001 | James | |
| 6,394,188 | B1 | 5/2002 | Zwergel | |
| 6,991,005 | B2 | 1/2006 | Fedeli | |
| 7,140,381 | B2 | 11/2006 | Sundholm et al. | |
| 7,281,672 | B2 | 10/2007 | Karalis et al. | |
| 7,562,670 | B1 * | 7/2009 | Jones | F16K 17/40 137/318 |
| 7,703,471 | B2 * | 4/2010 | Edwards | F16K 17/403 137/68.3 |
| 8,448,716 | B2 | 5/2013 | Yoshida | |
| 8,511,397 | B2 | 8/2013 | Frasure et al. | |
| 8,714,175 | B2 | 5/2014 | Fetner et al. | |
| 9,038,742 | B2 | 5/2015 | Porterfield, Jr. et al. | |
| 9,153,400 | B2 | 10/2015 | Frasure et al. | |
| 9,302,128 | B2 | 4/2016 | Dunster et al. | |
| 2006/0131034 | A1 | 6/2006 | Lahouati | |
| 2010/0154600 | A1 * | 6/2010 | Gui | B25B 15/04 81/60 |
| 2012/0043096 | A1 * | 2/2012 | Butz | A62C 99/0009 169/46 |
| 2013/0098639 | A1 * | 4/2013 | Dunster | A62C 13/003 169/9 |
| 2013/0186654 | A1 | 7/2013 | Dunster et al. | |
| 2013/0240221 | A1 | 9/2013 | Chaney et al. | |
| 2015/0107685 | A1 | 4/2015 | Porterfield et al. | |

FOREIGN PATENT DOCUMENTS

| | | |
|---|---|---|
| GB | 1567895 | 5/1980 |
| GB | 2048062 | 12/1980 |
| GB | 2241562 | 9/1991 |
| GB | 2466659 | 7/2010 |
| JP | H08238330 | 9/1996 |
| WO | 0147603 | 7/2001 |
| WO | 03089065 | 10/2003 |

OTHER PUBLICATIONS

EP Application No. 15176050.1 Extended European Search Report dated Dec. 1, 2015, 9 pages.

EP Application No. 15176344.8, Extended European Search Report dated Dec. 1, 2015, 6 pages.

* cited by examiner

MOTORIZED ACTUATOR FOR A FIRE EXTINGUISHER

BACKGROUND OF THE INVENTION

The subject matter disclosed herein relates to a fire extinguisher actuator. More specifically, the subject matter disclosed relates to a fire extinguisher actuator that activates the release of a fire extinguishing agent.

In an aircraft environment, hermetically sealed fire extinguishers are typically activated by direct explosive impingement energy using a pyrotechnic trigger device, such as a pyrotechnic cartridge or squib. The impingement energy is focused on a dome-shaped fire extinguisher outlet burst disc such that the fire extinguisher outlet burst disc will rupture as a result of the impingement. The fire extinguisher outlet burst disc is typically fabricated from corrosion resistant steel. Normally, the pyrotechnic trigger device is retained in a discharge head in such a manner that it directly faces the fire extinguisher outlet burst disc. The discharge head is attached to an outlet of the fire extinguisher and is typically used to direct the flow of extinguishing agent to an aircraft interface, such as plumbing or tubing, which directs the extinguishing agent to a desired location. A filter screen is located within the discharge head to catch any large fire extinguisher outlet burst disc fragments created as a result of the explosive impingement energy.

The use of pyrotechnic trigger devices can be effective; however, pyrotechnic trigger devices require special handling procedures and training that add to overall aircraft management and maintenance costs. Additionally, pyrotechnic trigger devices may have a limited expected life span and thus require periodic replacement.

BRIEF DESCRIPTION OF THE INVENTION

According to one aspect, a fire extinguisher actuator assembly for a fire extinguisher is provided. The fire extinguisher includes a fire extinguisher reservoir and a fire extinguisher outlet burst disc that forms a discharge barrier between the fire extinguisher reservoir and a discharge head to retain a pressurized fire extinguishing agent within the fire extinguisher reservoir. The fire extinguisher actuator assembly includes a cutter positioned within the fire extinguisher proximate the fire extinguisher outlet burst disc. The fire extinguisher actuator assembly also includes a motorized activation device having a drive shaft. The motorized activation device is operable to rotate the drive shaft and push the cutter to pierce the fire extinguisher outlet burst disc, thereby releasing the pressurized fire extinguishing agent through the discharge head.

According to another aspect, a method of installing a fire extinguisher actuator assembly in a fire extinguisher is provided. The fire extinguisher includes a fire extinguisher reservoir and a fire extinguisher outlet burst disc that forms a discharge barrier between the fire extinguisher reservoir and a discharge head to retain a pressurized fire extinguishing agent within the fire extinguisher reservoir. The method includes positioning a cutter within the fire extinguisher proximate the fire extinguisher outlet burst disc. A motorized activation device including a drive shaft is mounted within the fire extinguisher such that the motorized activation device is operable to rotate the drive shaft and push the cutter to pierce the fire extinguisher outlet burst disc, thereby releasing the pressurized fire extinguishing agent through the discharge head.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

In an exemplary embodiment, a fire extinguisher actuator assembly for a fire extinguisher is provided that is activated without a pyrotechnic trigger device. The fire extinguisher actuator assembly includes a motorized activation device that drives a cutter to release a pressurized fire extinguishing agent from the fire extinguisher. The cutter pierces a fire extinguisher outlet burst disc that retains the pressurized fire extinguishing agent in the fire extinguisher. The cutter may be detachably coupled to a pusher on a drive shaft of the motorized activation device such that upon piercing of the fire extinguisher outlet burst disc, the pressure of the pressurized fire extinguishing agent drives the cutter rapidly through the fire extinguisher outlet burst disc. Using a cutter to open a fire extinguisher outlet burst disc of a fire extinguisher may remove the need to include a debris screen in a discharge head of the fire extinguisher system, as loose fire extinguisher outlet burst disc fragments typically resulting from pyrotechnic trigger device ignition are no longer present.

Figure 1:
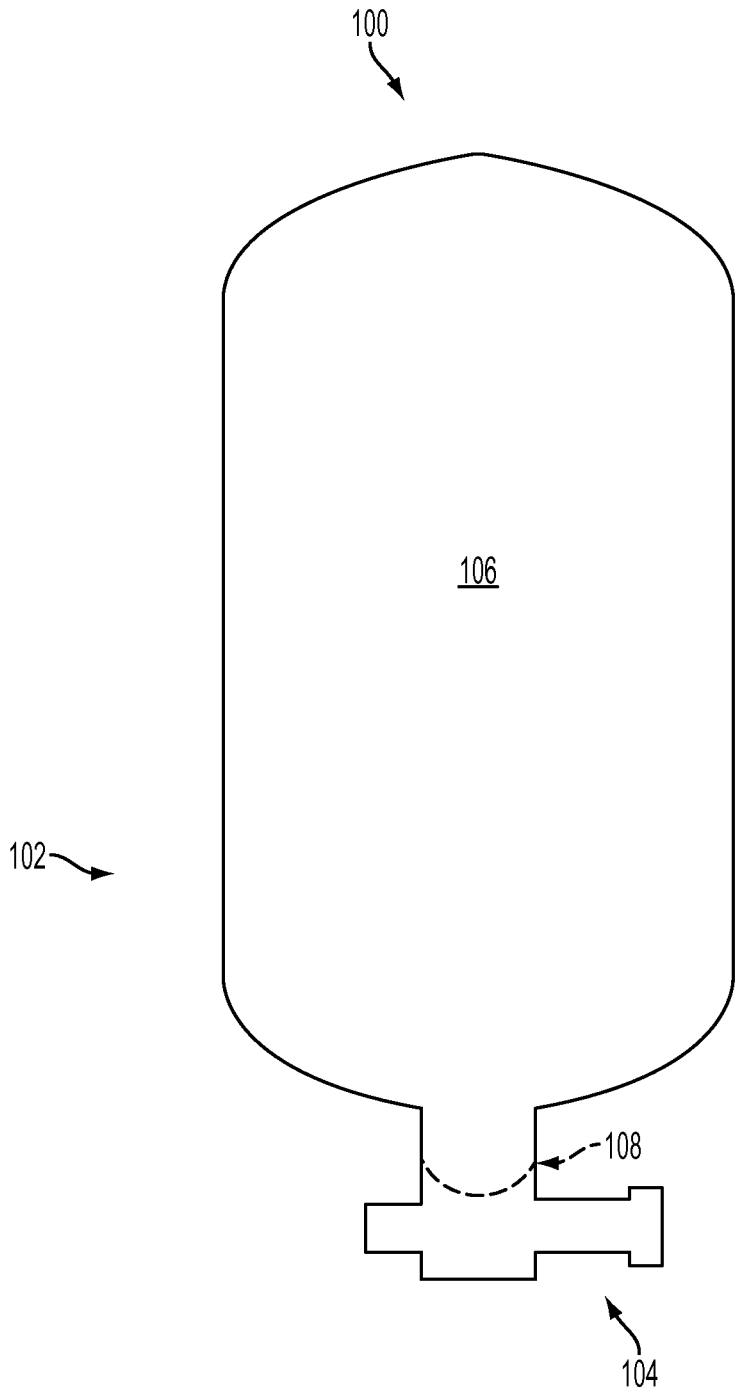
FIG. 1 is a schematic view of a fire extinguisher system according to an embodiment.

Turning now to FIG. 1, a schematic view of a fire extinguisher system 100 is depicted according to an embodiment. The fire extinguisher system 100 includes a fire extinguisher 102 and a discharge head 104. The fire extinguisher 102 includes a fire extinguisher reservoir 106 and a fire extinguisher outlet burst disc 108 that forms a discharge barrier between the fire extinguisher reservoir 106 and the discharge head 104 to retain a pressurized fire extinguishing agent within the fire extinguisher reservoir 106. The discharge head 104 can be interfaced to plumbing/tubing to direct fire extinguishing agent to a desired location, for example, within an aircraft.

Figure 2:
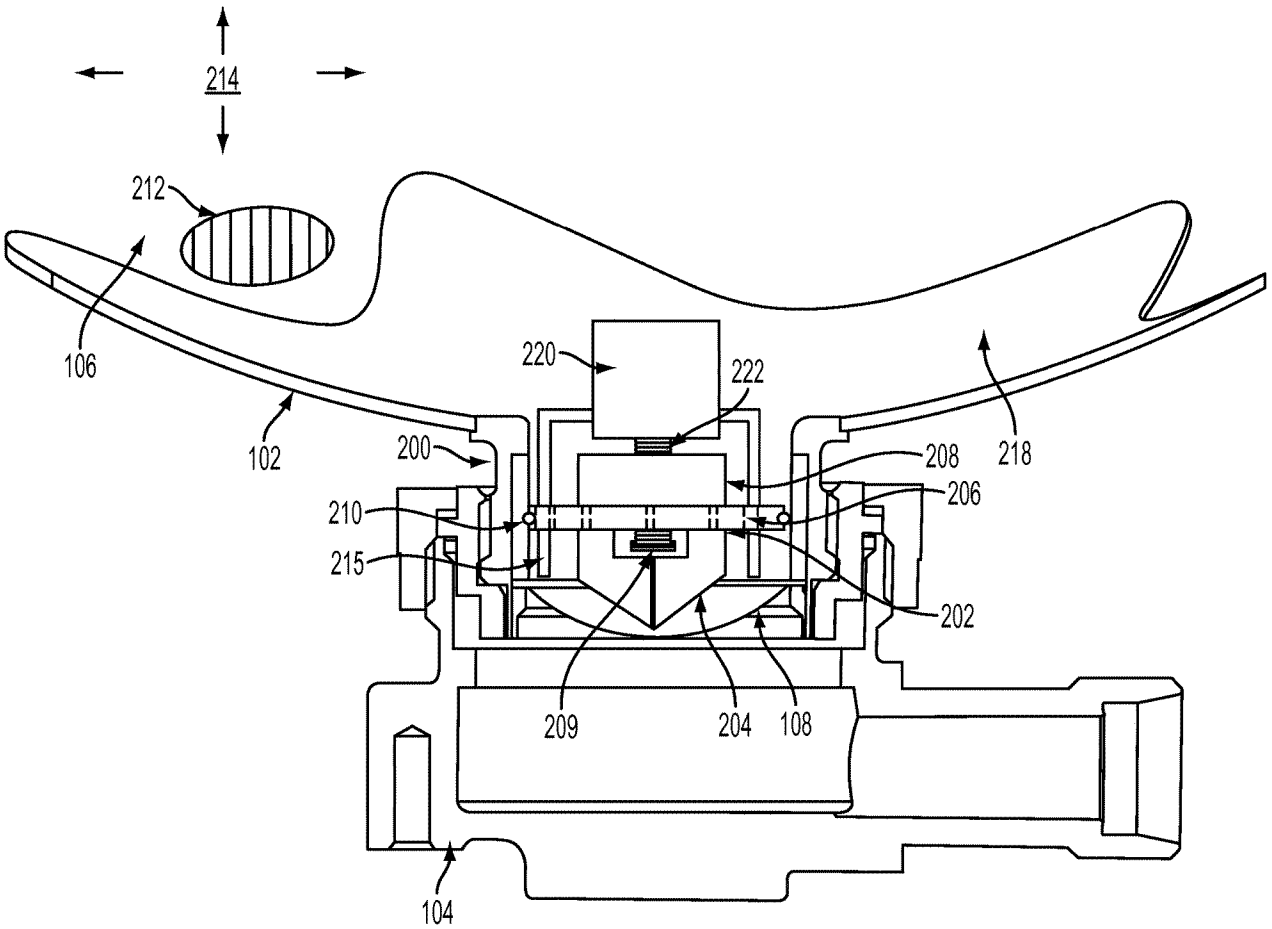
FIG. 2 is a detailed view of a fire extinguisher actuator assembly according to an embodiment.

FIG. 2 is a detailed view of a fire extinguisher actuator assembly 200 according to an embodiment. In the example of FIG. 2, the fire extinguisher actuator assembly 200 includes a cutter shuttle assembly 202 having a cutter 204 coupled to a shuttle body 206. The cutter shuttle assembly 202 including the cutter 204 is detained within the fire extinguisher 102 proximate the fire extinguisher outlet burst disc 108. The cutter shuttle assembly 202 can be detained by at least one flexible seal 210 (referred to as flexible seal 210 herein) until a force exerted by a motorized activation device 220 is sufficient to overcome a holding force of the flexible seal 210. The flexible seal 210 also serves as a detent to hold the cutter shuttle assembly 202 in place during shock and vibration such that the cutter 204 does not prematurely cut through the fire extinguisher outlet burst disc 108. Pressurized fire extinguishing agent 212 is held in the fire extinguisher reservoir 106 under internal fire extinguisher pressure 214.

The fire extinguisher actuator assembly 200 also includes the motorized activation device 220 having a drive shaft 222 that drives a pusher 208. The drive shaft 222 may include helical threading to mesh with the pusher 208, and thus the drive shaft 222 may also be referred to as a helical drive shaft. The drive shaft 222 can also include a shaft end cap 209 to retain the pusher 208 on the drive shaft 222. The motorized activation device 220 is operable to rotate the drive shaft 222 and push the cutter 204 to pierce the fire extinguisher outlet burst disc 108, thereby releasing the pressurized fire extinguishing agent 212 through the discharge head 104. As can be seen in the FIG. 2, the motorized activation device 220 can be mounted in the fire extinguisher reservoir 106. Anti-rotation guides 215 can be used to prevent the cutter shuttle assembly 202 from rotating while the motorized activation device 220 rotates the drive shaft 222. The anti-rotation guides 215 can be rigidly coupled to the motorized activation device 220 or another structure within the fire extinguisher 102. The motorized activation device 220 can be electrically driven, absent a pyrotechnic trigger device. For example, the motorized activation device 220 can be a dc motor, a dc geared motor, a linear motor, a rotational solenoid using a ratcheted drive, or other electrical motor type known in the art.

As will be understood, the fire extinguisher actuator assembly 200 can include other structure elements to support and stabilize the motorized activation device 220, as well as electrical connections, which are not depicted to simplify the drawings. The fire extinguisher reservoir 106 can be sized to accommodate a wide variety of installations. For example, the fire extinguisher reservoir 106 can range in size from 40 cubic inches (655.5 $cm^3$) to 2,500+ cubic inches (40,968+ $cm^3$). Pressure changes within the fire extinguisher reservoir 106 can occur due to ambient temperature variations. For example, in an aircraft environment, the fire extinguisher 102 may be at 240 degrees F. (115.6 degrees C.) on the ground on a hot day and after takeoff be at −65 degrees F. (−53.9 degrees C.) at altitude. These temperature changes cause substantial changes to the internal fire extinguisher pressure 214. Example nominal pressure values of the internal fire extinguisher pressure 214 can range from between about 300 pounds-per-square-inch (2,068 kPa) to about 800 pounds-per-square-inch (5,515 kPa) at 70 degrees F. (21.1 degrees C.), with higher pressures at higher temperatures and lower pressures at lower temperatures. Upon piercing the fire extinguisher outlet burst disc 108, the internal fire extinguisher pressure 214 can drive the cutter shuttle assembly 202 to disengage with the pusher 208 and the anti-rotation guides 215 to fully open the fire extinguisher outlet burst disc 108.

Figure 3:
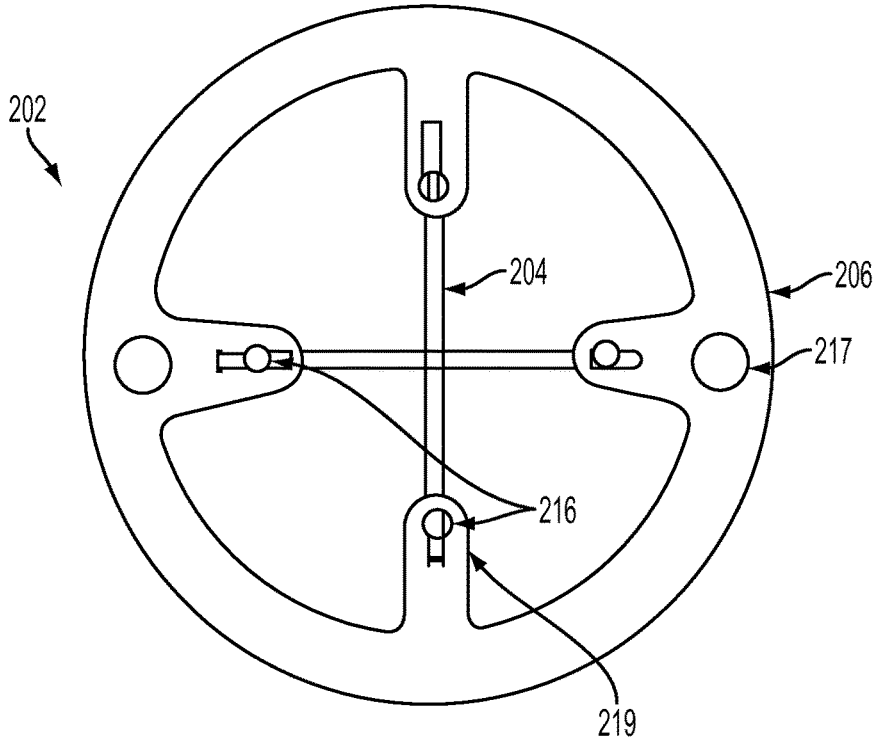
FIG. 3 is a top view of a cutter shuttle assembly according to an embodiment.
Figure 4:
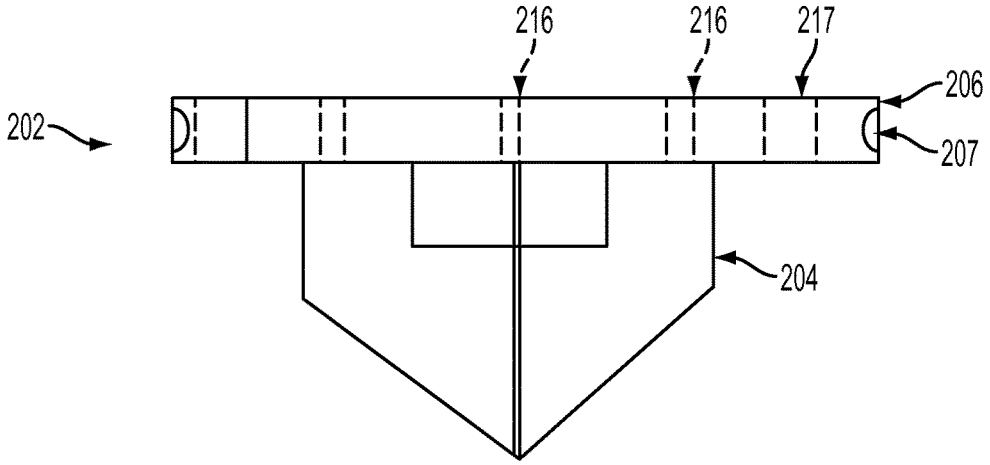
FIG. 4 is a side view of a cutter shuttle assembly according to an embodiment.

FIG. 3 is a top view of the cutter shuttle assembly 202 according to an embodiment. The shuttle body 206 includes an engagement interface 219 to engage with the pusher 208 of FIG. 2. As can be seen in the example of FIG. 3, the engagement interface 219 includes one or more pin holes 216. Alternatively, the engagement interface 219 can include pins, a combination of pins and pin holes, or an alternate structure to engage the pusher 208 of FIG. 2. The pin holes 216 can be located in close proximity to blades of the cutter 204. The shuttle body 206 also includes one or more anti-rotation holes 217 to engage one or more anti-rotation guides 215 of FIG. 2. As can be seen in FIG. 4, the shuttle body 206 further includes a gland 207 around its circumference to hold the flexible seal 210 of FIG. 2.

Figure 5:
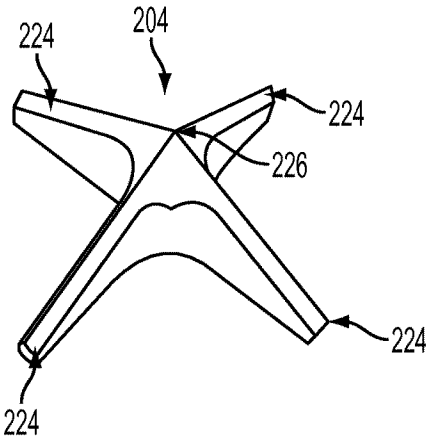
FIG. 5 is a perspective view of a cutter according to an embodiment.

FIG. 5 is a perspective view of the cutter 204 according to an embodiment. As can be seen in the example of FIG. 5, the cutter 204 includes four blades 224 intersecting at a central point 226 or cutting tip. The blades 224 may be uniformly spaced with about a 90 degree separation between the blades 224. The blades 224 may also be angled or sloped such that the central point 226 is a peak of the cutter 204.

Figure 7:
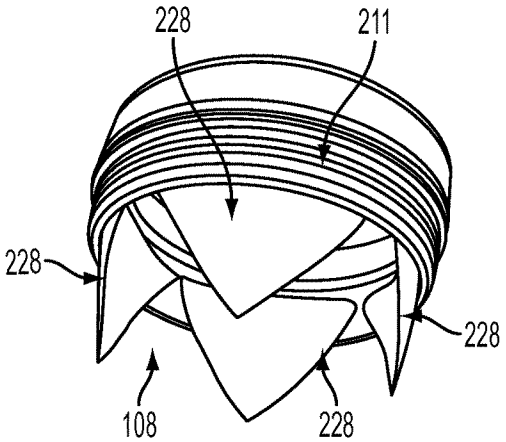
FIG. 7 is a perspective view of a fire extinguisher outlet burst disc after cutting according to an embodiment.
Figure 6:
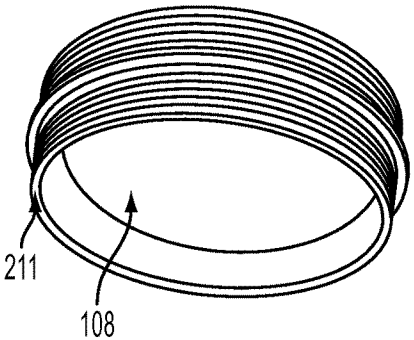
FIG. 6 is a perspective view of a fire extinguisher outlet burst disc prior to cutting according to an embodiment.

FIG. 6 is a perspective view of the fire extinguisher outlet burst disc 108 prior to cutting according to an embodiment. The fire extinguisher outlet burst disc 108 may be hermetically sealed by applying a weld to an outer perimeter of the fire extinguisher outlet burst disc 108 relative to a fire extinguisher outlet burst disc mounting assembly 211. FIG. 7 is a perspective view of the fire extinguisher outlet burst disc 108 after cutting according to an embodiment. When the cutter 204 of FIG. 2 is forced through the fire extinguisher outlet burst disc 108, the fire extinguisher outlet burst disc 108 splits and opens into a plurality of petals 228. The four blades 224 of FIG. 5 result in four petals 228. High pressure being released from the extinguisher reservoir 106 of FIG. 2 can rip the petals 228 fully open, while the hermetic sealing of the outer perimeter of the fire extinguisher outlet burst disc 108 retains the petals 228 to the fire extinguisher outlet burst disc mounting assembly 211.

Figure 8:
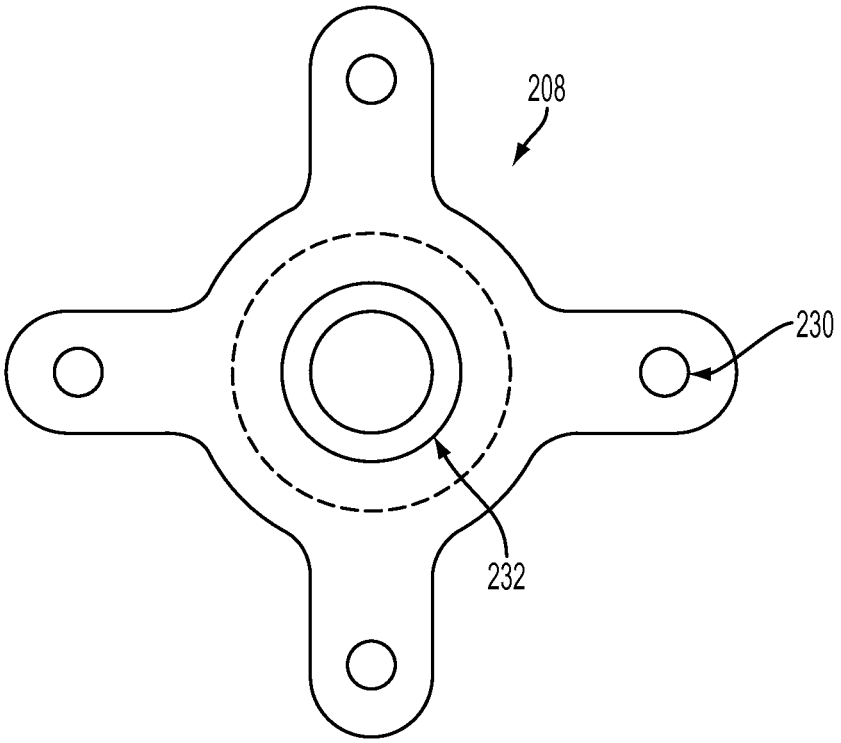
FIG. 8 is a top view of a pusher according to an embodiment.
Figure 9:
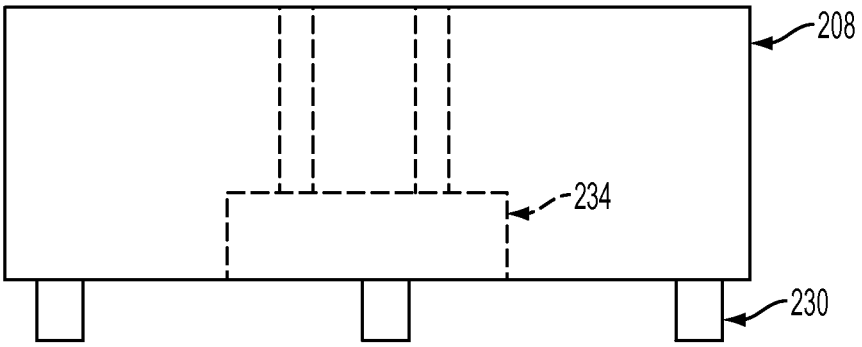
FIG. 9 is a side view of a pusher according to an embodiment.

FIG. 8 is a top view of the pusher 208 according to an embodiment. In the example of FIG. 8, the pusher 208 includes four pusher pins 230 that engage with the pin holes 216 of FIGS. 3 and 4. The pusher 208 also includes helical internal threads 232 to mesh with the drive shaft 222 of FIG. 2. As can be seen in FIG. 9, the pusher 208 may also include a recess 234 to receive the shaft end cap 209 of FIG. 2. The recess 234 and the shaft end cap 209 of FIG. 2 can prevent the pusher 208 from coming off of the drive shaft 222 of FIG. 2 when the cutter 204 of FIG. 2 pushes through the fire extinguisher outlet burst disc 108 of FIG. 2.

Figure 10:
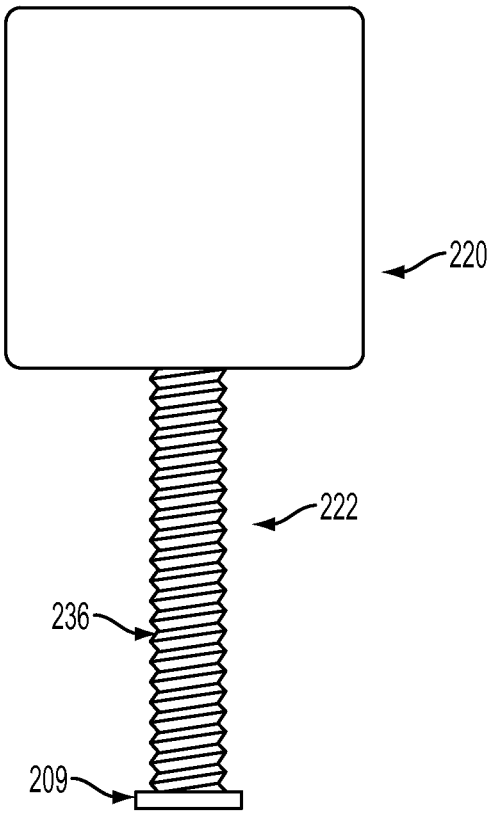
FIG. 10 is a view of a motorized activation device and drive shaft according to an embodiment.

FIG. 10 is a view of the motorized activation device 220 and drive shaft 222 according to an embodiment. Helical threads 236 can span a length of the drive shaft 222 between the motorized activation device 220 and the shaft end cap 209. Alternatively, only a portion of the drive shaft 222 upon which the pusher 208 of FIG. 2 engages may include the helical threads 236. The helical threads 236 are sized to engage with the helical internal threads 232 of the pusher 208 as depicted in FIG. 8.

Figure 11:
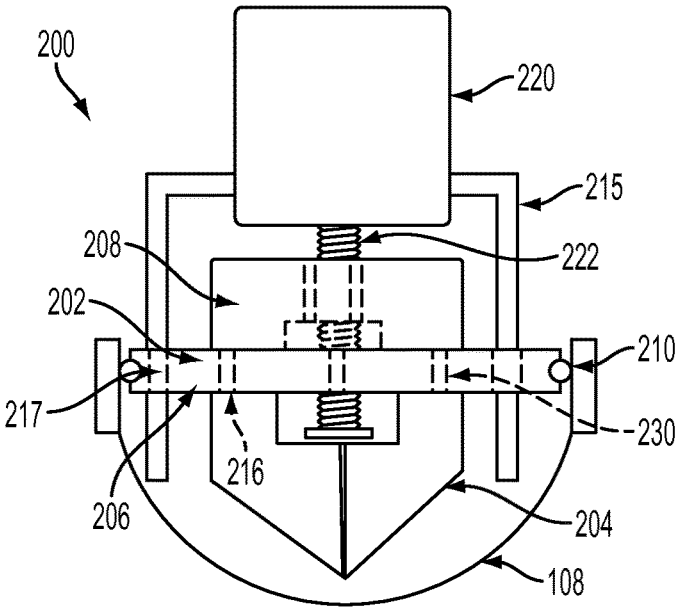
FIG. 11 is a view of a fire extinguisher actuator assembly prior to activation according to an embodiment.

FIG. 11 is a view of the fire extinguisher actuator assembly 200 prior to activation according to an embodiment. The one or more pusher pins 230 of the pusher 208 are inserted into the pin holes 216 of the shuttle body 206. The pusher 208 is also threaded on the drive shaft 222. The anti-rotation guides 215 pass through the anti-rotation holes 217 of the shuttle body 206 to prevent rotation of the cutter shuttle assembly 202. The flexible seal 210 holds the cutter shuttle assembly 202 in place prior to the motorized activation device 220 driving the cutter 204 to pierce the fire extinguisher outlet burst disc 108.

Figure 12:
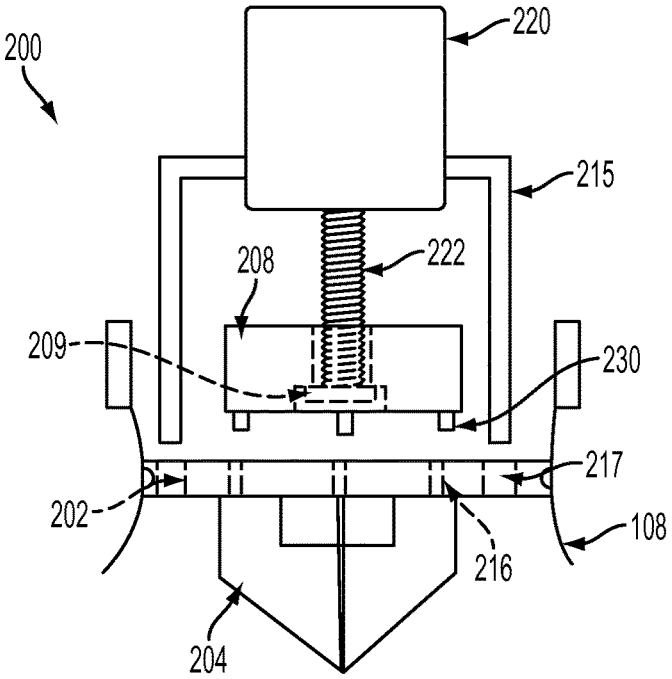
FIG. 12 is a view of a fire extinguisher actuator assembly after activation according to an embodiment.

FIG. 12 is a view of the fire extinguisher actuator assembly 200 after activation according to an embodiment. After the cutter 204 pierces the fire extinguisher outlet burst disc 108, the internal fire extinguisher pressure 214 of FIG. 2 can drive the cutter 204 through the fire extinguisher outlet burst disc 108 to fully open it. The pusher pins 230 of the pusher 208 can disengage from the pin holes 216, and the anti-rotation guides 215 can disengage from the anti-rotation holes 217. The pusher 208 is captured on the end of the drive shaft 222 by the shaft end cap 209. Not shown in FIG. 12, in order to simplify the drawings, is that the cutter shuttle assembly 202 will be restrained internally so it cannot become a projectile if the fire extinguisher 102 is inadvertently discharged while the discharge head 104 or other protective device are not in place at the time of the inadvertent discharge. The cutter shuttle assembly 202 will normally be retained in, and stopped by the discharge head 104 such that it does not become a projectile.

With reference to FIGS. 1-12, the fire extinguisher actuator assembly 200 can be installed in a fire extinguisher 102 according to an installation method. As previously described, the fire extinguisher 102 includes a fire extinguisher reservoir 106 and a fire extinguisher outlet burst disc 108 that forms a discharge barrier between the fire extinguisher reservoir 106 and a discharge head 104 to retain a pressurized fire extinguishing agent 212 at within the fire extinguisher reservoir 106. A cutter shuttle assembly 202 that includes a cutter 204 coupled to a shuttle body 206 is detained within the fire extinguisher 102 to position the cutter 204 proximate the fire extinguisher outlet burst disc 108. A motorized activation device 220 including a drive shaft 222 is mounted within the fire extinguisher 102 such that the motorized activation device 220 is operable to rotate the drive shaft 222 and push the cutter 204 to pierce the fire extinguisher outlet burst disc 108, thereby releasing the pressurized fire extinguishing agent 212 through the discharge head 104. A pusher 208 can be arranged on the drive shaft 222. The cutter shuttle assembly 202 can include an engagement interface 219 to engage with the pusher 208. The cutter shuttle assembly 202 may be detained by at least one flexible seal 210 until a force exerted by the motorized activation device 220 is sufficient to overcome a holding force of the flexible seal 210. The shuttle body 206 can also include one or more anti-rotation holes 217 to engage one or more anti-rotation guides 215. The motorized activation device 220 can be electrically driven, absent a pyrotechnic trigger device.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A fire extinguisher actuator assembly for a fire extinguisher, the fire extinguisher comprising a fire extinguisher reservoir and a fire extinguisher outlet burst disc that forms a discharge barrier between the fire extinguisher reservoir and a discharge head to retain a pressurized fire extinguishing agent within the fire extinguisher reservoir, the fire extinguisher actuator assembly comprising:

a cutter positioned within the fire extinguisher reservoir and proximate the fire extinguisher outlet burst disc, the cutter positioned to contact the pressurized fire extinguishing agent prior to piercing of the fire extinguisher outlet burst disc, wherein the cutter is coupled to a shuttle body to form a cutter shuttle assembly, and the cutter shuttle assembly further comprises an engagement interface to engage with a pusher;

a drive shaft comprising the pusher and a shaft end cap to retain the pusher on the drive shaft, wherein the drive shaft is a helical drive shaft; and a motorized activation device within the fire extinguisher reservoir and positioned to contact the pressurized fire extinguishing agent prior to piercing of the fire extinguisher outlet burst disc, the motorized activation device operable to rotate the drive shaft and push the cutter to pierce the fire extinguisher outlet burst disc, thereby releasing the pressurized fire extinguishing agent through the discharge head.

2. The fire extinguisher actuator assembly of claim 1, wherein the engagement interface comprises one or more pin holes, and the pusher comprises one or more pusher pins to engage with the one or more pin holes.

3. The fire extinguisher actuator assembly of claim 1, wherein the shuttle body further comprises one or more anti-rotation holes to engage one or more anti-rotation guides.

4. The fire extinguisher actuator assembly of claim 3, wherein the one or more anti-rotation guides are coupled to the motorized activation device.

5. The fire extinguisher actuator assembly of claim 1, wherein the cutter shuttle assembly is detained by at least one flexible seal until a force exerted by the motorized activation device is sufficient to overcome a holding force of the at least one flexible seal.

6. The fire extinguisher actuator assembly of claim 1, wherein the fire extinguisher outlet burst disc is hermetically sealed.

7. The fire extinguisher actuator assembly of claim 1, wherein the motorized activation device is electrically driven absent a pyrotechnic trigger device.

8. A method of installing a fire extinguisher actuator assembly in a fire extinguisher, the fire extinguisher comprising a fire extinguisher reservoir and a fire extinguisher outlet burst disc that forms a discharge barrier between the fire extinguisher reservoir and a discharge head to retain a pressurized fire extinguishing agent within the fire extinguisher reservoir, the method comprising:

positioning a cutter within the fire extinguisher reservoir and proximate the fire extinguisher outlet burst disc, the cutter positioned to contact the pressurized fire extinguishing agent prior to piercing of the fire extinguisher outlet burst disc, wherein the cutter is coupled to a shuttle body to form a cutter shuttle assembly, and the cutter shuttle assembly further comprises an engagement interface to engage with a pusher;

arranging the pusher on a drive shaft, wherein a shaft end cap retains the pusher on the drive shaft and the drive shaft is a helical drive shaft; and mounting a motorized activation device comprising the drive shaft within the fire extinguisher reservoir to contact the pressurized fire extinguishing agent prior to piercing of the fire extinguisher outlet burst disc such that the motorized activation device is operable to rotate the drive shaft and push the cutter to pierce the fire extinguisher outlet burst disc, thereby releasing the pressurized fire extinguishing agent through the discharge head.

9. The method of claim 8, wherein the cutter shuttle assembly is detained by at least one flexible seal until a force exerted by the motorized activation device is sufficient to overcome a holding force of the at least one flexible seal, and the shuttle body further comprises one or more anti-rotation holes to engage one or more anti-rotation guides.

10. The method of claim 8, wherein the motorized activation device is electrically driven absent a pyrotechnic trigger device.

* * * * *